US009135890B2

(12) United States Patent
Choi et al.

(10) Patent No.: US 9,135,890 B2
(45) Date of Patent: Sep. 15, 2015

(54) DISPLAY DEVICE AND DRIVING METHOD THEREOF

(75) Inventors: Yong-Jun Choi, Asan-si (KR); Jae Min Ha, Yongin-si (KR); Woo-Jin Jung, Seoul (KR)

(73) Assignee: Samsung Display Co., Ltd., Yongin (KR)

( * ) Notice: Subject to any disclaimer, the term of this patent is extended or adjusted under 35 U.S.C. 154(b) by 559 days.

(21) Appl. No.: 12/981,342

(22) Filed: Dec. 29, 2010

(65) Prior Publication Data

US 2011/0216098 A1 Sep. 8, 2011

(30) Foreign Application Priority Data

Mar. 5, 2010 (KR) ..... 10-2010-0020138

(51) Int. Cl.
*G09G 3/36* (2006.01)
*G09G 5/10* (2006.01)

(52) U.S. Cl.
CPC ..... *G09G 5/10* (2013.01); *G09G 3/3696* (2013.01); *G09G 2320/0257* (2013.01); *G09G 2320/0266* (2013.01)

(58) Field of Classification Search
CPC ..... G09G 3/3696; G09G 5/10; G09G 2320/0257; G09G 2320/0266
USPC ..... 345/690, 87, 89
See application file for complete search history.

(56) References Cited

U.S. PATENT DOCUMENTS

| | | | | |
|---|---|---|---|---|
| 2002/0126077 | A1 | 9/2002 | Baek | |
| 2003/0058235 | A1* | 3/2003 | Moon | 345/212 |
| 2004/0056868 | A1* | 3/2004 | Kato | 345/600 |
| 2006/0164356 | A1* | 7/2006 | Yang et al. | 345/89 |
| 2006/0208984 | A1* | 9/2006 | Kim et al. | 345/90 |
| 2007/0018922 | A1* | 1/2007 | Lee et al. | 345/89 |
| 2007/0040773 | A1* | 2/2007 | Lee et al. | 345/77 |
| 2007/0046601 | A1* | 3/2007 | Shin et al. | 345/89 |
| 2007/0080910 | A1* | 4/2007 | Park et al. | 345/77 |
| 2007/0229442 | A1 | 10/2007 | Yi | |
| 2009/0213055 | A1 | 8/2009 | Chung et al. | |

FOREIGN PATENT DOCUMENTS

| | | |
|---|---|---|
| JP | 3202450 | 6/2001 |
| JP | 2007-041548 | 2/2007 |
| KR | 10-2006-0001565 | 1/2006 |
| KR | 10-2006-0034915 | 4/2006 |

(Continued)

*Primary Examiner* — Jonathan Horner
(74) *Attorney, Agent, or Firm* — H.C. Park & Associates, PLC

(57) ABSTRACT

The present invention relates to a display device and a driving method thereof. A display device according to exemplary embodiments of the present invention includes: a signal controller to process an input image signal and an input control signal to control output of a digital image signal; a gray voltage generator to generate a gray reference voltage; and a data driver to generate gray voltages based on the gray reference voltage from the gray voltage generator, to receive the digital image signal, and to output a portion selected from the generated gray voltages as a data voltage, wherein the gray reference voltage includes a first gray reference voltage for the input image signal and a second gray reference voltage for an insertion gray, and the gray voltage generator generates one of the first gray reference voltage or the second gray reference voltage according to the selection signal included in the control signal to be provided to the data driver.

20 Claims, 14 Drawing Sheets

(56) References Cited

FOREIGN PATENT DOCUMENTS

| | | |
|---|---|---|
| KR | 10-2006-0060072 | 6/2006 |
| KR | 10-2006-0065224 | 6/2006 |
| KR | 10-2007-0016059 | 2/2007 |
| KR | 10-2007-0069707 | 7/2007 |
| KR | 10-2007-0117759 | 12/2007 |
| KR | 10-2008-0001796 | 1/2008 |
| KR | 10-2008-0003096 | 1/2008 |
| KR | 10-2008-0015301 | 2/2008 |
| KR | 10-2008-0034543 | 4/2008 |
| KR | 10-2009-72872 | 7/2009 |
| KR | 10-2009-0090673 | 8/2009 |

* cited by examiner

DISPLAY DEVICE AND DRIVING METHOD THEREOF

CROSS-REFERENCE TO RELATED APPLICATION

This application claims priority to and the benefit of Korean Patent Application No. 10-2010-0020138, on Mar. 5, 2010, which is herein incorporated by reference for all purposes as if fully set forth herein.

BACKGROUND OF THE INVENTION

1. Field of the Invention

Exemplary embodiments of the present invention relates to a method and an apparatus for driving a display device. More particularly, exemplary embodiments of the present invention relate to a liquid crystal display and a method for driving the liquid crystal display associated with offsetting afterimages of displaying images.

2. Description of the Related Art

Recent consumer trends expect lightweight and thin personal computers to meet mobility and lightweight and thin display televisions using flat panel displays satisfying such requirements which result in significant user's turning away conventional cathode ray tubes (CRTs) type televisions.

The flat panel display devices include, for example, a liquid crystal display (LCD) device, a field emission display (FED) device, an organic light emitting display (OLED) device, and a plasma display panel (PDP) device.

In general, the display device may include a display panel having a plurality of pixels including a switching element, and display signal lines, a gray voltage generator for generating a gray reference voltage, and a data driver for generating a plurality of gray voltages by using the gray reference voltage and applying the gray voltages corresponding to image signals among the gray voltages to the data lines among the display signal lines as data signals.

In some examples, the liquid crystal display may include two display panels respectively provided with a pixel electrode and a common electrode. In this example, the pixel electrodes may be arranged in a matrix and may be connected to the switching elements such as a thin film transistor (TFT), thereby sequentially receiving the data voltages one row by one row. The common electrode may be formed on the whole surface of the display panels and may receive a common voltage. Typically, when a voltage is applied to the two electrodes, an electric field may be generated in the liquid crystal layer. The intensity of the electric field may be adjusted to control the transmittance of light passing through the liquid crystal layer, thereby obtaining a desired image.

However, a degradation phenomenon or flickering may be generated as the electric field is applied in one direction for a long period of time, the polarity of a data voltage with respect to a common voltage may be inverted by frame, row, or pixel to avoid degrade image quality.

A liquid crystal display may display a fixed picture for a predetermined time period, for example, for a frame. As an example, when a continuously moving object is displayed, the object stays at a specific position for a frame and then stays at a position for a time period after the object being moved in a next frame, consequently, movement of the object may discretely be displayed. Moreover, when a user views the continuously moving object on the screen, the user may see blurry image by the mismatched screen in terms of the discrete display panels associated with driving method of the discrete panel display device. Particularly, in the case of driving the discrete panel display device over long time period, the control of the liquid crystal molecules may not be properly performed such that afterimages which cause degrading images may be generated.

To address the above problems, an approach has been introduced in which the image is displayed only during a portion of one frame while black is displayed during the rest of the time. This approach uses a charge sharing voltage under the polarity inversion in the data driver to display the black, and actually applying data to represent the black when displaying the image. However, this approach may cause a charging deterioration, and may generate afterimages such as a data reflection, or transverse line deterioration.

The above information disclosed in this background section is only to set up Applicant's recognition of problems within the existing art and merely for enhancement of understanding of the background of the invention based on the identified source of problems, and therefore the above information, which is the Applicant's own statement, cannot be used as prior art in determining obviousness into the present invention.

SUMMARY OF THE INVENTION

Exemplary embodiments of the present invention provide a display device capable of generating a gray voltage associated with an image signal to improve display quality.

Additional features of the invention will be set forth in the description which follows, and in part will be apparent from the description, or may be learned by practice of the invention.

Exemplary embodiments of the present invention provide a display device. The display device includes a controller to process an input image signal and an input control signal and to output a digital image signal and a control signal. The display device includes a gray voltage generator to generate a gray reference voltage. The display device also includes a data driver to generate gray voltages based on the gray reference voltage, to receive the digital image signal, and to output a portion selected from the generated gray voltages as a data voltage. The gray reference voltage comprises a first gray reference voltage with respect to the input image signal and a second gray reference voltage with respect to an insertion gray. The gray voltage generator generates one of the first gray reference voltage or the second gray reference voltage to provide one of the reference voltages to the data driver according to a selection signal, the control signal comprising the selection signal.

Exemplary embodiments of the present invention provide a method for driving a display device including a controller to process an input image signal and an input control signal to control output a digital image signal, a gray voltage generator to generate a gray reference voltage, and a data driver to generate gray voltages based on the gray reference voltage. The method includes generating a first gray reference voltage with respect to the input image signal or a second gray reference voltage with respect to an insertion gray, and the generation is performed according to a selection signal comprising the control signal. The method also includes receiving one of the first gray reference voltage or the second gray reference voltage. The method includes dividing the received gray reference voltage to generate the gray voltages, and selecting gray voltage among the generated gray voltages to output a data voltage.

Exemplary embodiments of the present invention provide a method for offsetting an afterimage of a display device. The method includes determining series of image signals and characteristics of display device whether an afterimage is occurred. The method also includes defining a gray reference voltage according to a degree of the afterimage and the characteristics of the display device. The method includes selecting, using a selection signal, a gray voltage based on the defined gray reference voltage, wherein the selection corresponds to the determined afterimage of the image signals and the characteristics of the display device, wherein the selected gray voltages are controlled by a selection signal which comprises a black data voltage comprising various tones of gray, and the selection signal controls the gray reference voltage. The method also includes applying the selected gray voltages, using the selection signal, to image signals to offset the afterimage, wherein the selected gray voltages are fed to a driver to control displaying images.

Exemplary embodiments of the present invention provide an apparatus. The apparatus includes a logic coupled to a voltage generator to determine whether an afterimage is occurred, and to define a gray reference voltage according to a degree of the afterimage and characteristics of the display device. A controller, using a selection signal, selects a gray voltage based on the defined gray reference voltage. The selection corresponds to the determined afterimage of an image signal and the characteristics of the display device. The selected gray voltages are controlled by a selection signal comprising a black data voltage which represents various tones of gray, and the selected gray voltage is fed to a driver to control displaying images to offset the afterimage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
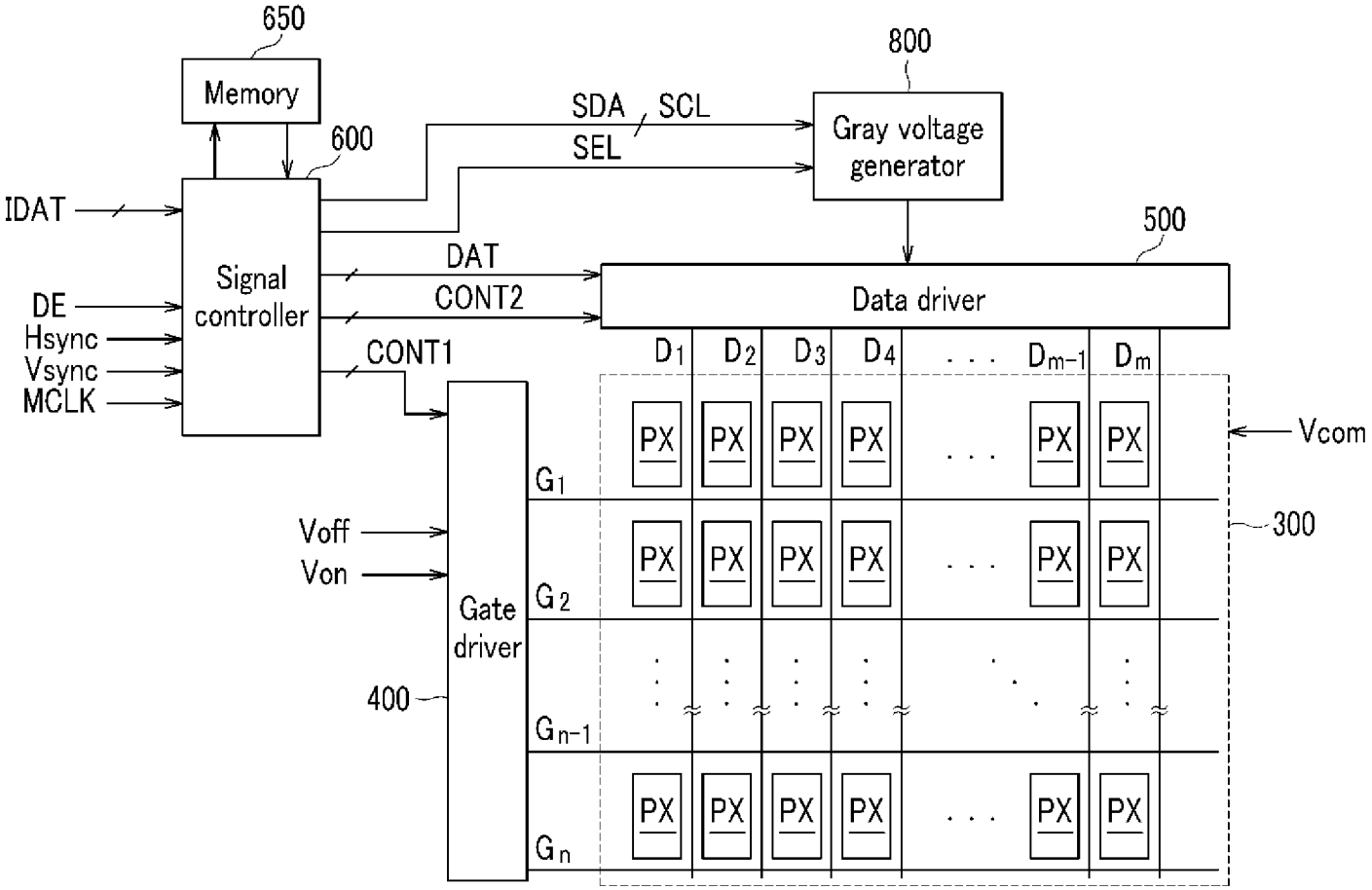
FIG. 1 is a block diagram of a display device according to exemplary embodiments of the present invention.

Advantages and features of the present invention can be understood more readily by reference to the following detailed description of exemplary embodiments and the accompanying drawings. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art.

In the drawings, the sizes and relative sizes of the thickness of layers, films, panels, regions may be exaggerated for clarity. Like reference numerals designate like elements throughout the specification. It is understood that when an element such as a layer, a film, a region, or a substrate is referred to as being "on" or "coupled to" another element, it can be directly on or coupled to the other element or intervening elements may also be present. In contrast, when an element is referred to as being "directly on" or "directly coupled to" another element, there are no intervening elements present.

Figure 2:
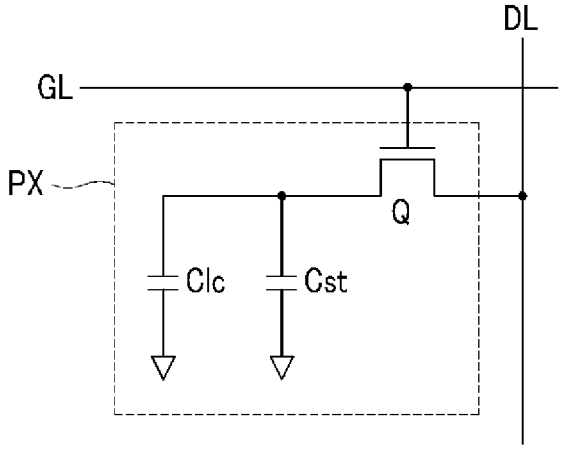
FIG. 2 is a circuit diagram of one pixel of the display device of FIG. 1.

FIG. 1 is a block diagram of a display device according to exemplary embodiments of the present invention, and FIG. 2 is a circuit diagram of one pixel of the display device of FIG. 1.

As shown in FIG. 1, a display device according to exemplary embodiments of the present invention includes a display panel 300, a gate driver 400 and a data driver 500. The gate driver 400 is coupled to gate lines of the display panel 300 and the data driver is coupled to data lines of the display panel 300. A gray voltage generator 800 is coupled to the data driver 500 to generate a gray reference voltage, and the gray voltage generator 800 is coupled to a signal controller 600 which controls the gate driver 400 and the data driver 500 for displaying an image.

For example, the display panel 300 may include a plurality of display signal lines, and a plurality of pixels PX that are correspondingly coupled to the display signal lines and are substantially arranged in a matrix shape. In some examples, in a structure shown in FIG. 1, the display panel 300 includes lower and upper panels (not shown) that face each other, and a liquid crystal layer (not shown) that is interposed between the two panels.

The display signal lines include a plurality of gate lines G1 to Gn that transmit gate signals (also referred to as "scanning signals") and data lines D1 to Dm that transmit data signals. In FIG. 2, the gate lines G1-Gn are representatively indicated by GL, and the data lines D1-Dm are representatively indicated by DL.

Referring to FIG. 2, each pixel PX includes a switching element Q coupled to the corresponding gate line GL and the data line DL, and coupled to a liquid crystal capacitor Clc and a storage capacitor Cst. In some examples, the storage capacitor Cst may be omitted.

The liquid crystal capacitor Clc uses a pixel electrode (not shown) of the lower panel to receive a data voltage from the data line DL and a common electrode of the upper panel as two terminals. A liquid crystal layer disposed between the two electrodes may be served as a dielectric material. The storage capacitor Cst may have an assistant function of the characteristics of the liquid crystal capacitor Clc.

Referring to FIG. 1, the gate driver 400 is coupled to the gate lines G1-Gn and synthesizes a gate-on voltage Von and a gate-off voltage Voff to generate the gate signals to the gate lines G1-Gn.

The gray voltage generator 800 is connected to the signal controller by an inter-integrated circuit ($I^2C$) method, thereby receiving a data SDA and a clock signal SCL to generate gray reference voltages. The gray reference voltages include a voltage having a positive value and a voltage having a negative value with respect to the common voltage Vcom.

A memory 650 connected to the signal controller 600 stores digital data on the gray reference voltage, and outputs the stored digital data to the signal controller 600.

The data driver 500 connected to the data lines D1-Dm of the display panel 300 divides the gray reference voltage from the gray voltage generator 800, generates gray voltages for the entire gray levels, and selects data voltages from among the gray voltages.

The signal controller 600 controls operations of the gate driver 400 and the data driver 500.

The signal controller 600 receives input image signals IDAT and input control signals for controlling the display of the input image signals IDAT such as a vertical synchronizing signal Vsync, a horizontal synchronizing signal Hsync, a main clock signal MCLK, and a data enable signal DE from an external graphics controller (not shown). After the image signals IDAT are properly processed to be suitable for the operating conditions of the display panel 300 based on the input image signal IDAT and the input control signal of the signal controller 600, and a gate control signal CONT1 and a data control signal CONT2 are generated, the gate control signal CONT1 is output to the gate driver 400, the data control signal CONT2 and the processed image signals DAT are output to the data driver 500, and a selection signal SEL for controlling the gray voltage generator 800 is generated to be output. The selection signal SEL is a signal for controlling the generation of the gray reference voltage in the gray voltage generator 800.

In accordance with the data control signal CONT2 generated from the signal controller 600, the data driver 500 receives digital image data (i.e the processed image signals) DAT for the pixel PX of one row and selects gray voltages corresponding to the respective digital image data DAT to convert the digital image data DAT into an image data voltage Vdat or a black data voltage VBL, and to apply them to the corresponding data lines D1-Dm. The image data voltage Vdat corresponds to the input image signal IDAT, and the black data voltage VBL is not limited to black-tone gray but may represent a predetermined gray or a gray in a predetermined range among the entire grays. For example, the black data voltage VBL may represent a middle-tone gray such as a gray color. For example, when there are 256 grays in total, the black-tone gray is 0 gray, the middle-tone gray has a middle value near the 128 gray, and a low-tone gray is a gray between the middle-tone gray and the black-tone gray. To improve the afterimages, the value of the black data voltage VBL may be determined based on various grays, and the possible gray to correspond to the black data voltage VBL may be in the range of about 0 to 255 gray. However the black data voltage VBL corresponding to a gray among grays from about 0 to about 128 gray may be effective to improve the after images. In some examples, the black-tone gray (0 gray) or the middle-tone gray (128 gray) may be selected. Hereafter, the image data voltage Vdat and the black data voltage VBL together are referred to as a data voltage. Also, the black means a predetermined gray or a predetermined gray range such as a the black-tone gray (0 gray) or a middle-tone gray (e.g., 128 gray) that is inserted regardless of the input image signal IDAT, and the black data voltage VBL means a data voltage to display such the black. As described above, the gray represented by the black data voltage VBL may be determined according to the display device and the display characteristics, and such the gray is hereinafter referred to as an insertion gray. In some examples, the insertion gray may be black-tone gray such as 0 gray or a middle-tone gray such as 128 gray.

The gate driver 400 applies the gate-on voltage Von to a gate line G1-Gn in response to the scanning control signals CONT1 generated from the signal controller 600, thereby turning on the switching element Q connected thereto, and thereby the data voltage Vdat/VBL applied to the data lines D1-Dm is fed to the corresponding pixel PX through the turned-on switching element Q.

If the common electrode is applied with the common voltage Vcom and the pixel electrode is applied with the data voltage Vdat/VBL, the voltage difference of the two electrodes is represented as a pixel voltage of each pixel, and the liquid crystal molecules of the liquid crystal layer between the two electrodes are inclined according to the pixel voltage. Thus, the degree of polarization of light incident to the liquid crystal layer is changed according to the inclination degree, and thereby the pixel PX displays the luminance corresponding to the gray of the input image signal IDAT or the luminance corresponding to the insertion gray.

The above operation is repeatedly performed with a horizontal period 1H corresponding to one period of the horizontal synchronization signal Hsync and the data enable signal DE, the gate-on voltage Von is sequentially applied to all the gate lines G1 to Gn, and the data voltage Vdat/VBL is applied to all the pixels so as to display an image of one frame.

After one frame ends, a subsequent frame is started and a state of the inversion signal RVS applied to the data driver 500 to invert the polarity of the data voltage applied to each pixel PX from the polarity of a previous frame is controlled, which is referred to as "frame inversion". In this case, in one frame, the polarity of the data voltage flowing through one data line may periodically be changed according to characteristics of the inversion signal RVS (e.g., row inversion and dot inversion), or the polarities of the data voltage applied to one pixel row may be different (e.g., column inversion and dot inversion).

Next, a driver of the display device and an operation thereof according to the exemplary embodiment of the present invention are described with reference to FIG. 3 as well as FIG. 1 and FIG. 2. Like reference numerals are assigned to the same constituent elements related to the previous exemplary embodiment of FIG. 1 and FIG. 2, and the same description is omitted in order to avoid unnecessarily obscuring the invention.

Figure 3:
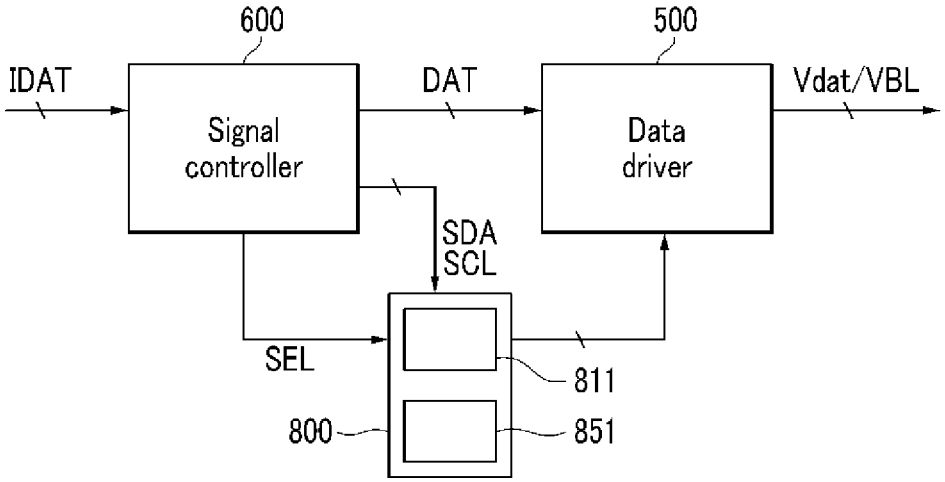
FIG. 3 and FIG. 4 are block diagrams of a driver of the display device according to exemplary embodiments of the present invention.

FIG. 3 is a block diagram of a driver of a display device according to exemplary embodiments of the present invention.

The gray voltage generator 800 according to exemplary embodiments of the present invention includes a register 811 and an additional register 851.

The register 811 and the additional register 851 store the digital gray reference data that is stored in the memory 650, and the digital gray reference data includes information for the gray reference voltage generated in the gray voltage generator 800. The register 811 stores the digital gray reference data for the input image signal IDAT, and the additional register 851 stores the digital gray reference data for the insertion gray. The digital gray reference data of the register 811 may depend on an inherent gamma curve of the display device, and the digital gray reference data of the additional register 851 may depend on a gamma curve capable of representing the luminance corresponding to the insertion gray regardless of a change of the gray.

The selection signal SEL provided to the gray voltage generator 800 from the signal controller 600 selects whether to generate a gray reference voltage according to the digital gray reference data of the register 811 or to generate the gray reference voltage according to the digital gray reference data of the additional register 851. According to the selected register 811 and 851, the gray voltage generator 800 generates several levels of gray reference voltages to generate the image data voltage Vdat for the input image signal IDAT and provides the gray reference voltages to the data driver 500, or generates a gray reference voltage or several levels of gray reference voltages to generate the black data voltage VBL corresponding to the insertion gray and provides the gray reference voltage(s) to the data driver 500.

The number of gray reference voltages generated by the register 811 is changed according to the input digital data SDA, and an exemplary voltage may be 18. For example, the gray reference voltage generated by the additional register 851 may be several or one.

The data driver 500 may generate an image data voltage Vdat for the input image signal IDAT according to the gray reference voltage inputted from the gray voltage generator to provide the image data voltage to the data line, or may provide the black data voltage VBL for displaying the insertion gray to the data line.

Next, a gray voltage generator according to exemplary embodiments of the present invention is described with reference to FIG. 4, FIG. 5, and FIG. 6. Like reference numerals are assigned to the same constituent elements related to the previous exemplary embodiment, and the same description is omitted in order to avoid unnecessarily obscuring the invention.

Figure 4:
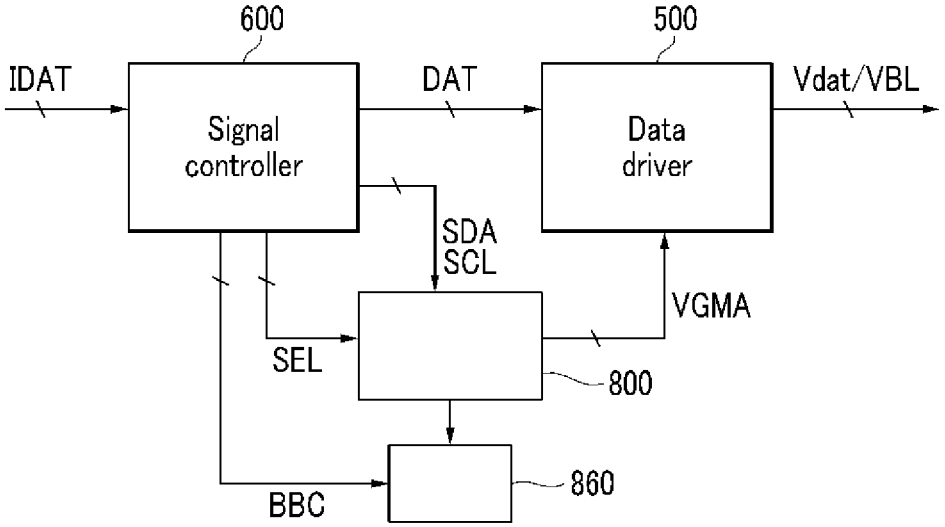
Figure 5:
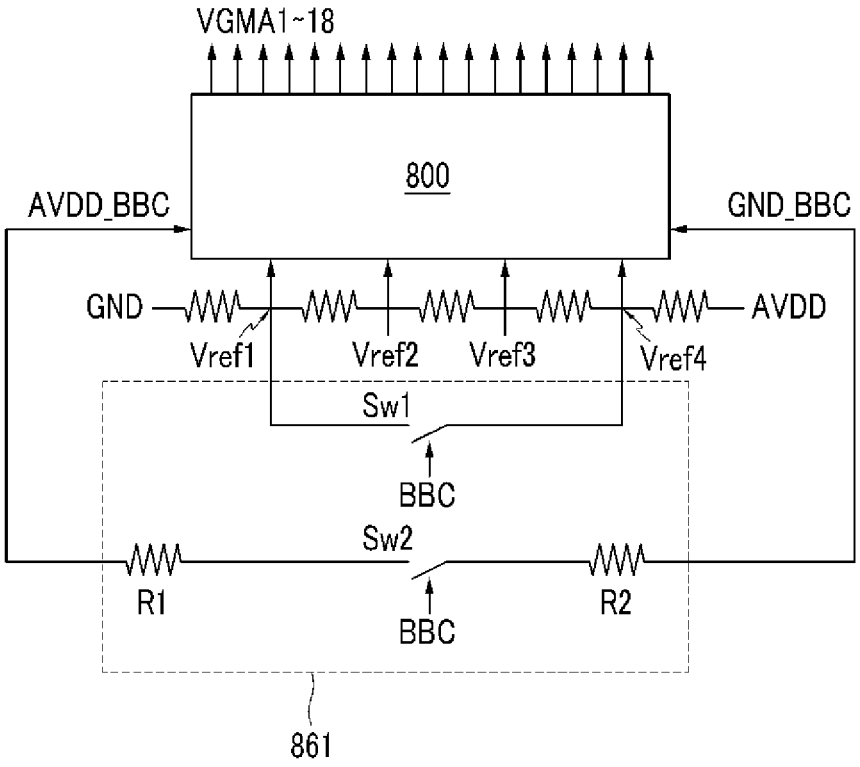
FIG. 5 and FIG. 6 are circuit diagrams of a gray voltage generator of the display device of FIG. 4.
Figure 6:
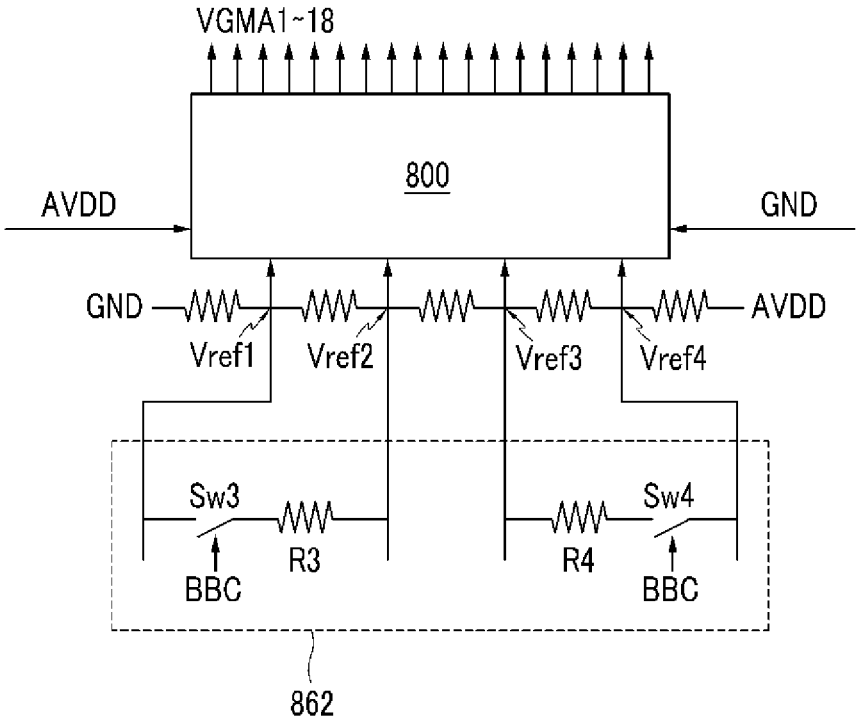

FIG. 4 is a block diagram of a driver of the display device according to exemplary embodiments of the present invention, and FIG. 5 and FIG. 6 are circuit diagrams of a gray voltage generator according to exemplary embodiments of the present invention of the display device of FIG. 4.

A driver of a display device according to exemplary embodiments of the present invention may include a transform circuit 860 coupled to the gray voltage generator 800.

In some examples, the gray voltage generator 800 may include a register (not shown), which is from the exemplary embodiment of FIG. 3. The register stores the digital gray reference data for the input image signal IDAT, and thereby the gray voltage generator generates a plurality of gray reference voltages VGMA. Even though the selection signal SEL is shown in FIG. 4, it may be omitted in the present exemplary embodiment in order to avoid unnecessarily obscuring the invention.

The operation of the transform circuit 860 is controlled according to the transform signal BBC from the signal controller 600. When the transform signal BBC is high, the transform circuit 860 is activated to change the value of the gray reference voltage VGMA generated in the gray voltage generator 800, and when the transform signal BBC is low, the transform circuit 860 is deactivated such that the gray voltage generator 800 is not influenced. However, when the transform signal BBC is low, the transform circuit 860 may be activated, and when the transform signal BBC is high, the transform circuit 860 may be deactivated.

In some examples, the gray voltage generator 800 and the transform circuit 860 are described with reference to FIG. 5.

Referring to FIG. 5, the gray voltage generator 800 outputs the gray reference voltage VGMA to the data driver 500 through the 18 output terminals, wherein the number of output terminals may be changed. A resistor column including a plurality of resistors coupled between the driving voltage AVDD and the ground voltage GND are provided outside the gray voltage generator 800. The resistor column divides the driving voltage AVDD to provide the four reference voltages Vref1-Vref4 to the gray voltage generator 800. Alternatively, the gray voltage generator 800 may internally include the resistor column to provide the reference voltage.

The transform circuit 861 includes two switches Sw1 and Sw2 and two resistors R1 and R2.

The switch Sw1 is coupled in parallel to three resistors of the resistor column, and is turned-on/turned-off according to the transform signal BBC. The switch Sw2 is coupled in series between two resistors R1 and R2 that are connected in series, and is turned-on/turned-off according to the transform signal BBC. If the switches Sw1 and Sw2 are turned on according to the transform signal BBC, the value of the reference voltages Vref1 and Vref4 inputted to the gray voltage generator 800 is changed, and the driving voltage AVDD and the ground voltage GND inputted to the gray voltage generator 800 are also changed into the driving voltage AVDD_BBC and the ground voltage GND_BBC that are inputted to the gray voltage generator 800. Accordingly, the gray reference voltages VGMA1-VGMA18 that are generated by the gray voltage generator 800 all become at least one voltage corresponding to the insertion gray such as the black-tone gray (e.g. 0 gray) or the middle-tone gray (e.g. 128 gray).

In some examples, only one of the driving voltage AVDD and the ground voltage GND may be changed.

Accordingly, since the gray reference voltage VGMA supplied to the data driver 500 is made of the gray reference voltage corresponding to the insertion gray, the data voltage generated in the data driver 500 also becomes the black data voltage VBL to display the insertion gray such as the black-tone gray (e.g. 0 gray) or the middle-tone gray (e.g. 128 gray).

Next, another exemplary embodiment related to the gray voltage generator 800 and the transform circuit 860 of FIG. 4 is described with reference to FIG. 6 while focusing on the differences from the exemplary embodiment of FIG. 5.

Referring to FIG. 6, a transform circuit 862 according to the exemplary embodiments of the present invention includes two switches Sw3 and Sw4 coupled in series, and two resistors R3 and R4 coupled in series therebetween.

If the switches Sw3 and Sw4 are turned on according to the transform signal BBC, two resistors R3 and R4 are respectively coupled in parallel to a corresponding resistor among the resistor column such that the reference voltages Vref1-Vref4 input to the gray voltage generator 800 are changed. Accordingly, the gray reference voltages VGMA1-VGMA18 generated by the gray voltage generator 800 are changed according to the transform signal BBC, and if the value of the resistors R3 and R4 is controlled, the gray reference voltages VGMA1-VGMA18 may all become one gray reference voltage corresponding to the insertion gray such as the black-tone gray (e.g. 0 gray) or the middle-tone gray (e.g. 128 gray), or at least one voltage corresponding to the image of the middle-tone gray of the predetermined range. Accordingly, the gray reference voltage VGMA supplied to the data driver 500 may be made of the gray reference voltage corresponding to the insertion gray, and in this case, the data voltage generated in the data driver 500 becomes the black data voltage VBL to be outputted to the data line.

Next, a driving method of the display device according to exemplary embodiments of FIG. 1 to FIG. 6 is described with reference to FIG. 7 and FIG. 8.

Figure 7:
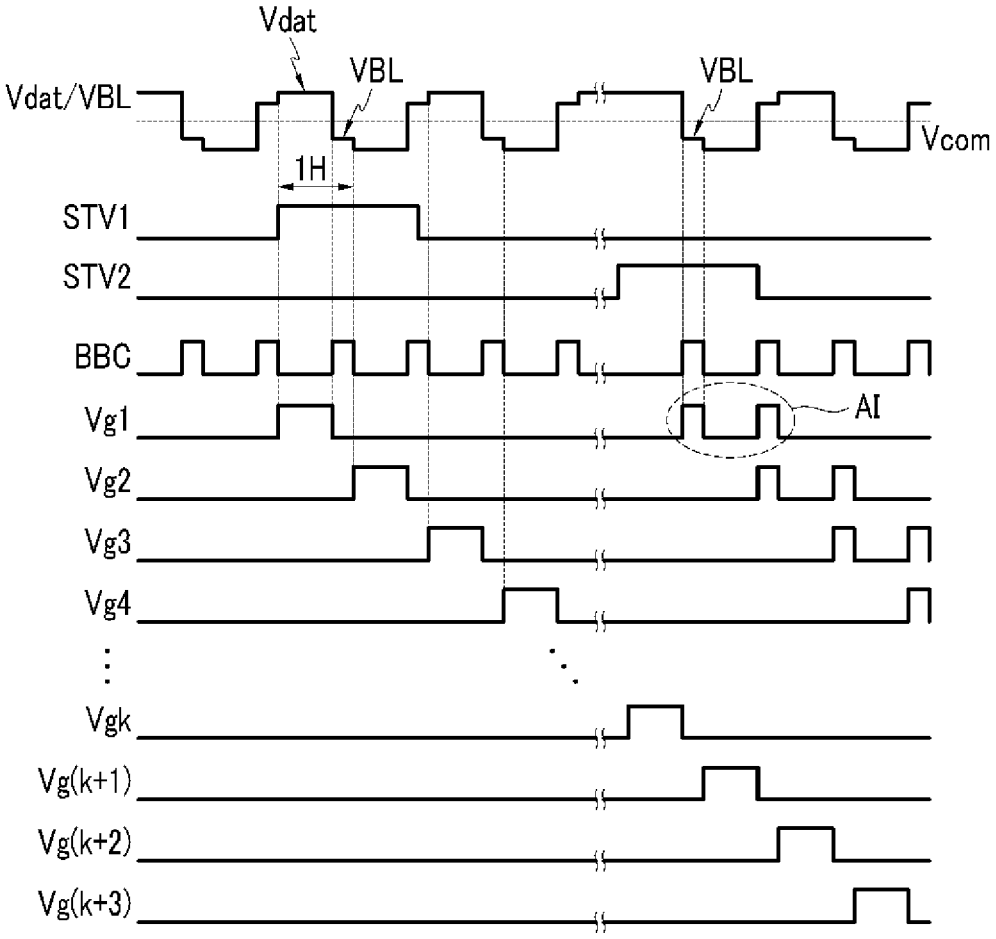
FIG. 7 is a diagram showing driving signals according to exemplary embodiments of the present invention.
Figure 8:
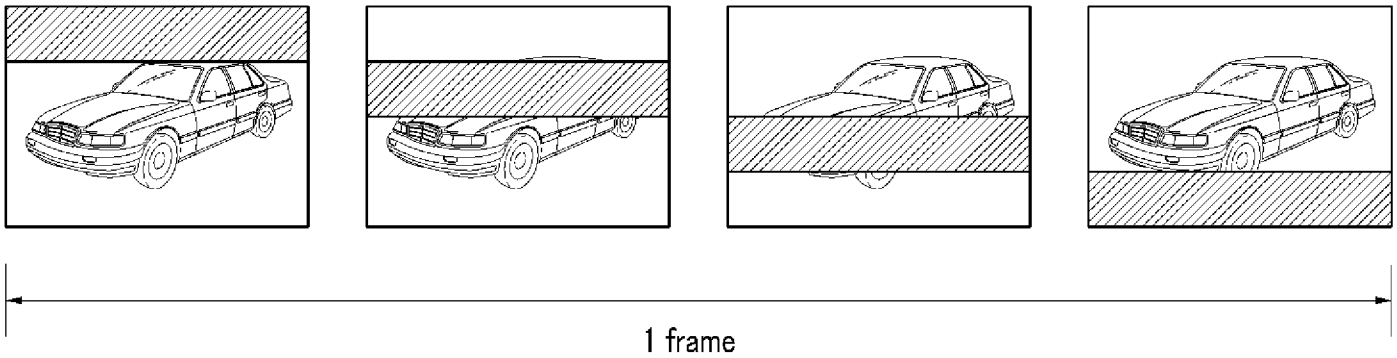
FIG. 8 is a schematic diagram showing a screen of the display device displayed according to the driving signals of FIG. 7.

FIG. 7 is a diagram showing driving signals according to exemplary embodiments of the present invention, and FIG. 8 is a schematic diagram showing a screen of the display device displayed according to the driving signals of FIG. 7.

Referring to FIG. 7, the polarity of the image data voltage Vdat applied to one data line is inverted every 1H such that the display device is driven by row inversion or dot inversion.

If the first scanning start signal STV1 becomes high, the gate signals Vg1, Vg2, Vg3, Vg4, . . . , Vgk−Vg k+3, . . . of the plurality of gate lines sequentially become the gate-on voltage, and the data lines are sequentially applied with the image data voltage Vdat having the positive polarity and the negative polarity during the time when the respective gate lines are applied with the gate-on voltage. The transform signal BBC may be low during the time when the image data voltage Vdat is applied.

On the other hand, if the transform signal BBC is high, the data voltage of the data line becomes the black data voltage VBL. The black data voltage VBL is applied to the pixel PX connected to the corresponding data line at the time AI when the gate-on voltage is applied to the gate line according to the second scanning start signal STV2, and the pixel PX applied with the black data voltage VBL may display the insertion gray such as the black or black-tone gray (e.g. 0 gray) or the middle-tone gray (e.g. 128 gray), as shown in FIG. 8.

According to the exemplary embodiment of FIG. 8, the screen displays a stripe of the insertion gray, for example, 0 gray or 128 gray, moving downward in the screen. However, the screen may be divided by various methods according to the timing of the several driving signals of FIG. 7 to variously display the insertion gray. For example, the black data voltage VBL may be applied during one frame disposed between two frames when the image for the input image signal IDAT is displayed, or it may be applied by pixel row or by a plurality of pixel rows during one frame.

As described above, by setting the gray reference voltage inputted from the gray voltage generator 800 to the data driver 500 to a gray reference voltage corresponding to the insertion gray, the black data voltage VBL may actively be applied to the data line like the image data voltage Vdat, and thereby the time of displaying the insertion gray such as the black-tone gray (e.g. 0 gray) or the middle-tone gray (e.g. 128 gray) may sufficiently be obtained without reducing the charging time of the image data voltage Vdat.

Next, a display device and a driving method thereof according to another exemplary embodiment of the present invention are described with reference to FIG. 9 and FIG. 10. The same description as that of the previous exemplary embodiment may be omitted in order to avoid unnecessarily obscuring the invention, and different points may mainly be described.

Figure 9:
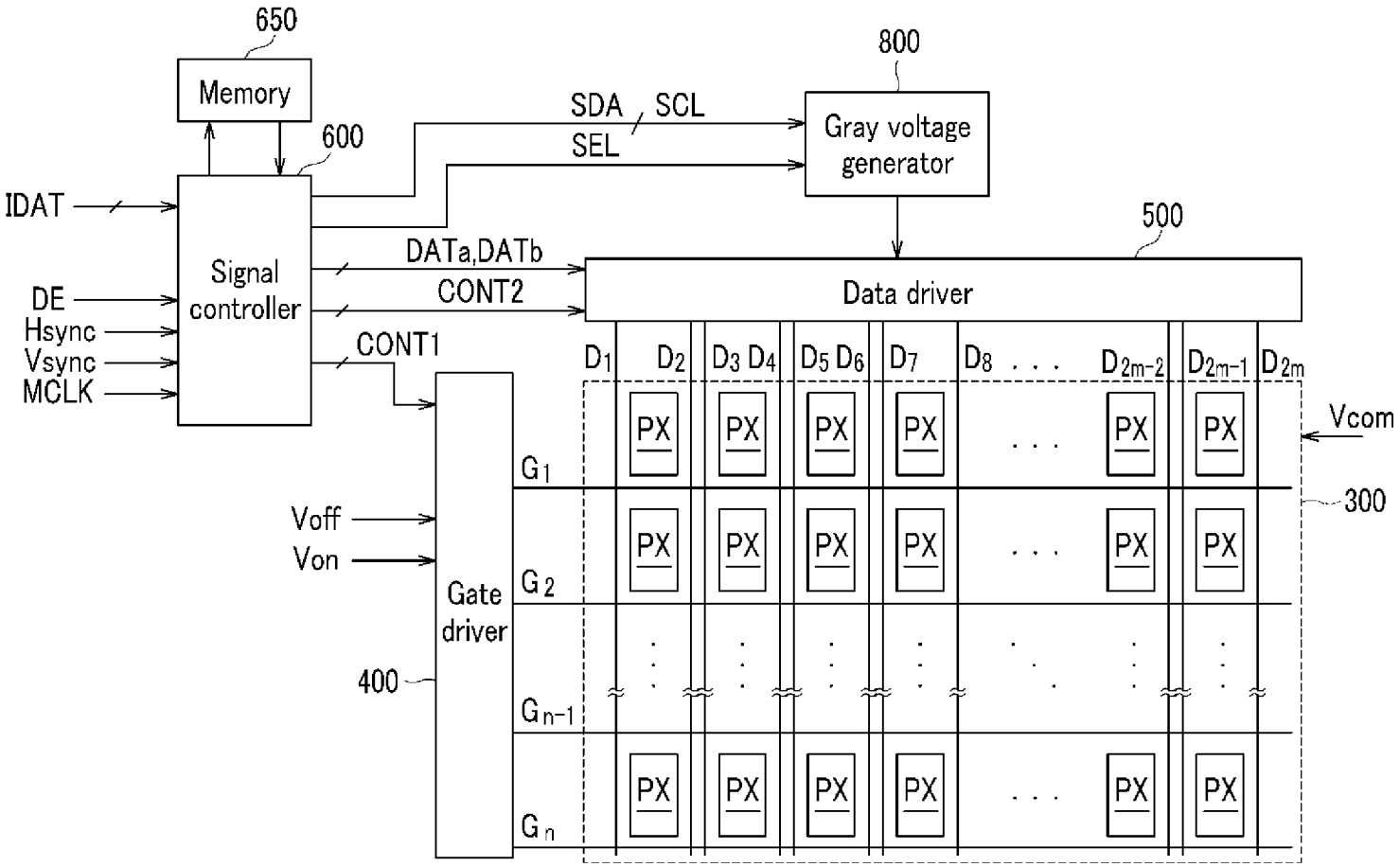
FIG. 9 is a block diagram of a display device according to exemplary embodiments of the present invention.
Figure 10:
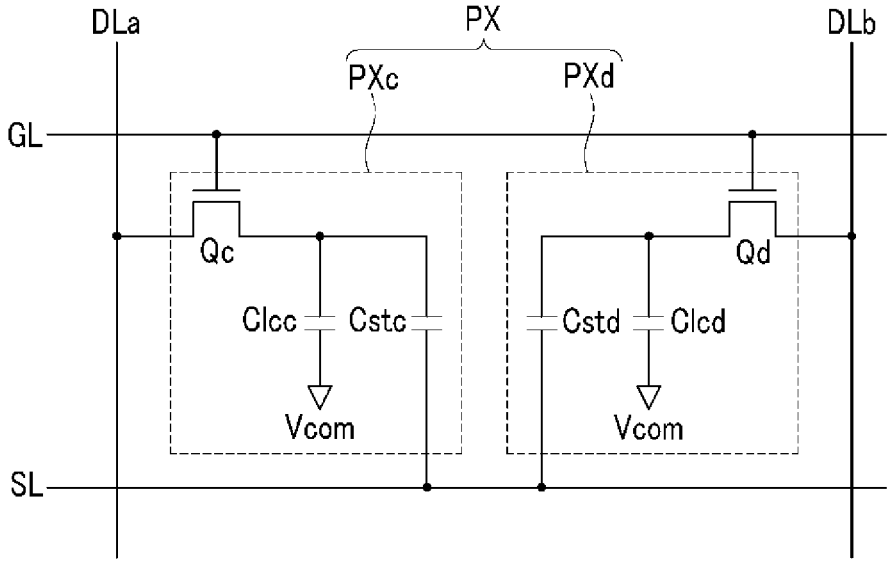
FIG. 10 is a circuit diagram of one pixel of the display device of FIG. 9.

FIG. 9 is a block diagram of a display device according to exemplary embodiments of the present invention, and FIG. 10 is a circuit diagram of one pixel of the display device of FIG. 9.

As shown in FIG. 9, a display device as a liquid crystal display according to exemplary embodiments of the present invention includes a display panel 300, a gate driver 400 and a data driver 500 coupled thereto, a gray voltage generator 800 coupled to the data driver 500, and a signal controller 600 is provided to control the gray voltage generator 800 and the data driver 500.

The display signal lines of the display panel 300 include a plurality of gate lines G1-Gn, and a plurality of pairs of data lines D1-D2*m*. In FIG. 10, the gate lines G1-Gn are representatively indicated by GL, and the pairs of the data lines D1-D2*m* are representatively indicated by DLa and DLb. For example, the display signal lines may include a storage electrode line SL.

Referring to FIG. 10, for example each pixel PX may include two subpixels PXc and PXd, and the subpixels PXc and PXd respectively may include switching elements Qc and Qd coupled to the corresponding gate lines GL and data lines DLa and DLb, liquid crystal capacitors Clcc and Clcd and switching elements Qc and Qd coupled thereto, and storage capacitors Cstc and Cstd coupled to the storage electrode line SL. The two subpixels PXc and PXd display images having different luminances according to different gamma curves for the same input image signal IDAT, thereby improving the lateral visibility.

The gray voltage generator 800 generates one gray reference voltage group related to the transmittance of the pixel PX. One gray reference voltage group may be provided to both the subpixels PXc and PXd forming one pixel PX, and includes one set having a positive value and another set having a negative value with respect to the common voltage Vcom. However, instead of one gray reference voltage group, two gray reference voltage groups that are respectively provided to the two subpixels PXc and PXd may be generated.

The signal controller 600 receives the input image signal IDAT and the input control signal controlling the display thereof. The input image signals IDAT are properly processed based on the input image signal IDAT and the input control signal of the signal controller 600 to generate the digital image signal, and it is output to the data driver 500. The processed image signal includes digital image signals DATa and DATb for the subpixel PXc and the subpixel PXd.

Next, a driver and an operation thereof of the display device according to the exemplary embodiments shown in FIG. 9 and FIG. 10 are described with reference to FIG. 9 and FIG. 10 as well as FIG. 11. Like reference numerals are assigned to the same constituent elements as that of the previous exemplary embodiment, and the same description is omitted in order to avoid unnecessarily obscuring the invention.

Figure 11:
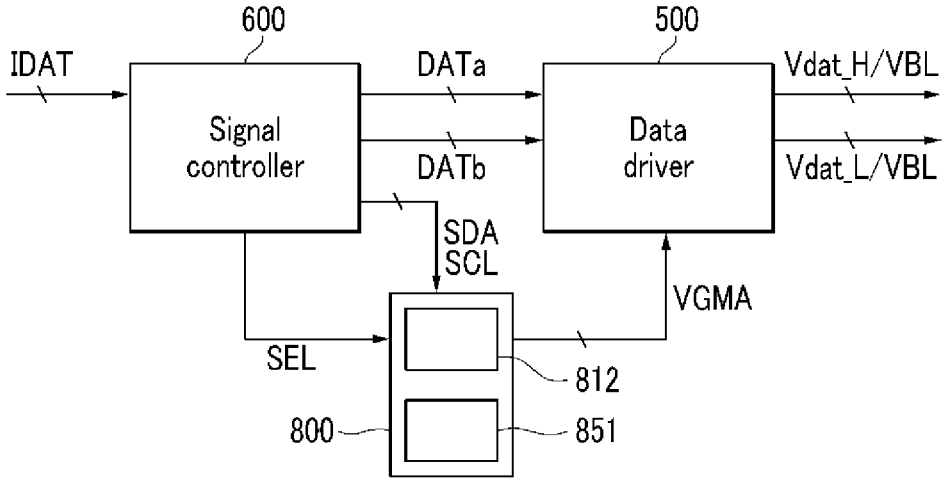
FIG. 11 is a block diagram of a data driver and a signal controller of the display device according to exemplary embodiments of the present invention.

FIG. 11 is a block diagram of a driver of a display device according to exemplary embodiments of the present invention.

A gray voltage generator 800 according to exemplary embodiments of the present invention may include a register 812 and an additional register 851, and may substantially be the same as the exemplary embodiment of FIG. 3.

Depending on whether the gray reference voltage VGMA inputted from the gray voltage generator is generated according to the register 812 or the additional register 851, the data driver 500 may generate a pair of image data voltages Vdat_H and Vdat_L from the digital image signals DATa and DATb for two subpixels PXc and PXd inputted from the signal controller 600 and supply them to the data line, or may supply the black data voltage VBL to the data line.

The gray voltage generator according to exemplary embodiments of the display device shown in FIG. 9 and FIG. 10 is the same as the exemplary embodiments of FIG. 4, FIG. 5, and FIG. 6, and the driving method is also the same.

Next, a driving method of the display device according to the exemplary embodiments of FIG. 4 to FIG. 6 which is applied to the exemplary embodiment of FIG. 9 to FIG. 11 is described with reference to FIG. 12. Like reference numerals are assigned to the same signals of the previous exemplary embodiment of FIG. 7, and the description thereof is omitted in order to avoid unnecessarily obscuring the invention.

Figure 12:
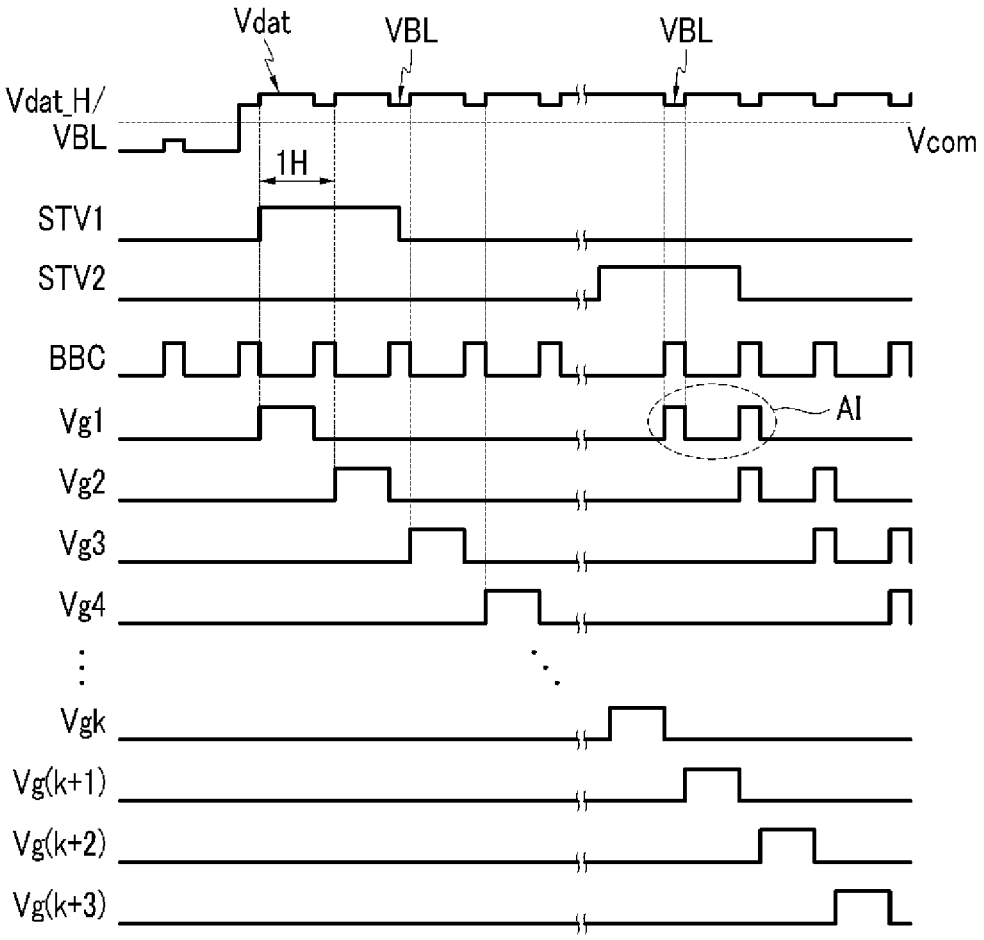
FIG. 12 is a diagram showing driving signals according to an exemplary embodiment of the present invention.

FIG. 12 is a waveform diagram of several driving signals according to exemplary embodiments of the present invention.

Different from the exemplary embodiment of FIG. 7, in the exemplary embodiment of FIG. 12, the polarity of the image data voltage Vdat applied to one data line is converted for the frame thereby realizing the frame inversion.

In this exemplary embodiment, if the data lines are applied with the image data voltages Vdat_H/Vdat_L of the positive or negative polarity and the gate line is applied with the gate-on voltage during the time that the transform signal BBC is low, the pixel PX connected thereto displays the image corresponding to the input image signal IDAT. Meanwhile, if the transform signal BBC is high, the data voltage of the data line becomes the black data voltage VBL representing the insertion gray, and when the corresponding gate line is applied with the gate-on voltage (AI), the pixel PX is supplied with the black data voltage VBL, and thereby that pixel PX may display the insertion gray such as the black-tone gray (e.g. 0 gray) or the middle-tone gray (e.g. 128 gray), as shown in FIG. 8.

In some examples, the various characteristics and effects of the above exemplary embodiments of FIG. 1 to FIG. 8 may be applied to the present exemplary embodiment FIG. 9 to FIG. 12.

Next, a display device and a driving method thereof according to another exemplary embodiment of the present invention are described with reference to FIG. 13 and FIG. 14. The same description as that of the previous exemplary embodiment of FIG. 1 and FIG. 2 may be omitted in order to avoid unnecessarily obscuring the invention, and different points may mainly be described.

Figure 13:
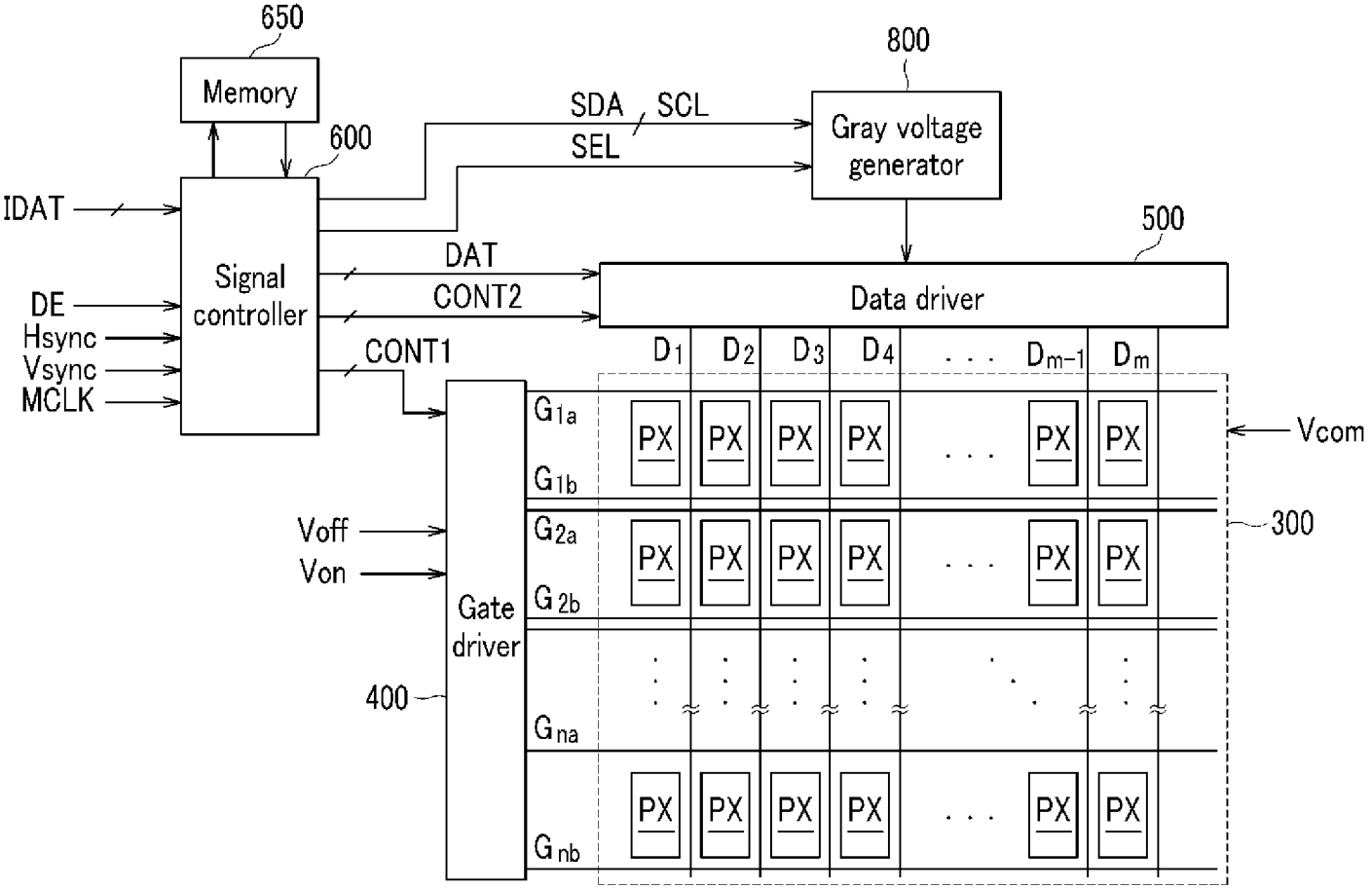
FIG. 13 is a block diagram of a display device according to exemplary embodiments of the present invention.
Figure 14:
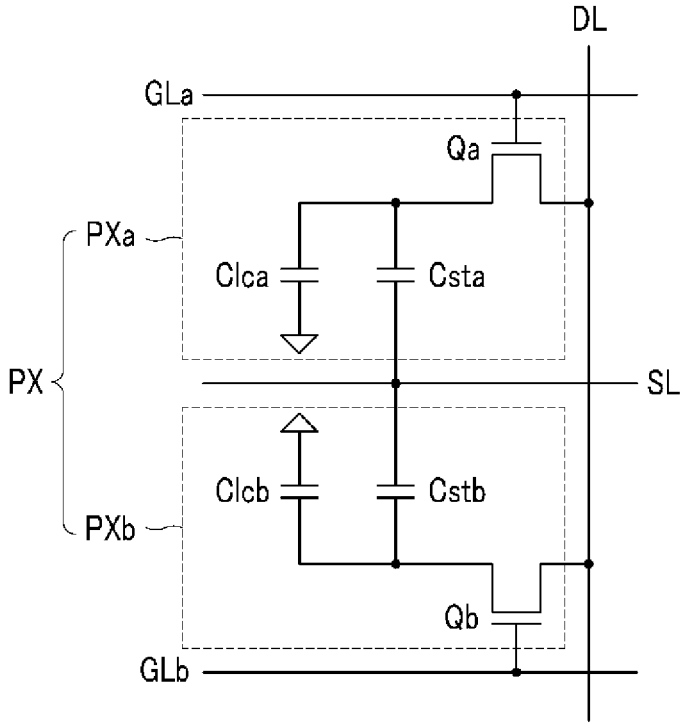
FIG. 14 is a circuit diagram of one pixel of the display device of FIG. 13.

FIG. 13 is a block diagram of a display device according to exemplary embodiments of the present invention, and FIG. 14 is a circuit diagram of one pixel of the display device of FIG. 13.

As shown in FIG. 13, a display device as a liquid crystal display according to exemplary embodiments of the present invention includes a display panel 300, a gate driver 400 and a data driver 500. The gate driver 400 is coupled to gate lines of the display panel 300 and the data driver is coupled to data lines of the display panel 300. A gray voltage generator 800 is coupled to the data driver 500 to generate a gray reference voltage, and the gray voltage generator 800 is coupled to a signal controller 600 which controls the gate driver 400 and the data driver 500 or displaying an image.

The display signal lines of the display panel 300 include a plurality of pairs of gate lines G1*a*, G1*b*, . . . Gna, Gnb, and a plurality of data lines D1-Dm. In FIG. 14, a pair of the gate lines G1*a*-Gnb are representatively indicated by GLa and GLb, and the data lines D1-Dm are representatively indicated by DL. Also, the display signal lines may include a storage electrode line SL.

Referring to FIG. 14, each pixel PX includes two subpixels PXa and PXb, and the subpixels PXa and PXb respectively include switching elements Qa and Qb coupled to the corresponding gate lines GLa GLb and the data lines DL, liquid crystal capacitors Clca and Clcb and switching elements Qa and Qb coupled thereto, and storage capacitors Csta and Cstb coupled to the storage electrode line SL. The two subpixels PXa and PXb display images having different luminances according to different gamma curves for the same input image signal IDAT, thereby improving the lateral visibility.

The gray voltage generator 800 generates two gray reference voltage groups related to the transmittance of the pixel PX. The two gray reference voltage groups are respectively provided to two subpixels PXa and PXb forming one pixel PX, and each of the gray reference voltage groups includes one set having the positive value and another set having the negative value with respect to the common voltage Vcom. However, in some examples, instead of two gray reference voltage groups, only one gray reference voltage group may be generated.

Next, a driver and an operation thereof of the display device according to the exemplary embodiments shown in FIG. 13 and FIG. 14 are described with reference to FIG. 13 and FIG. 14 as well as FIG. 15. Like reference numerals are assigned to the same constituent elements as that of the previous exemplary embodiment, and the same description may be omitted in order to avoid unnecessarily obscuring the invention.

Figure 15:
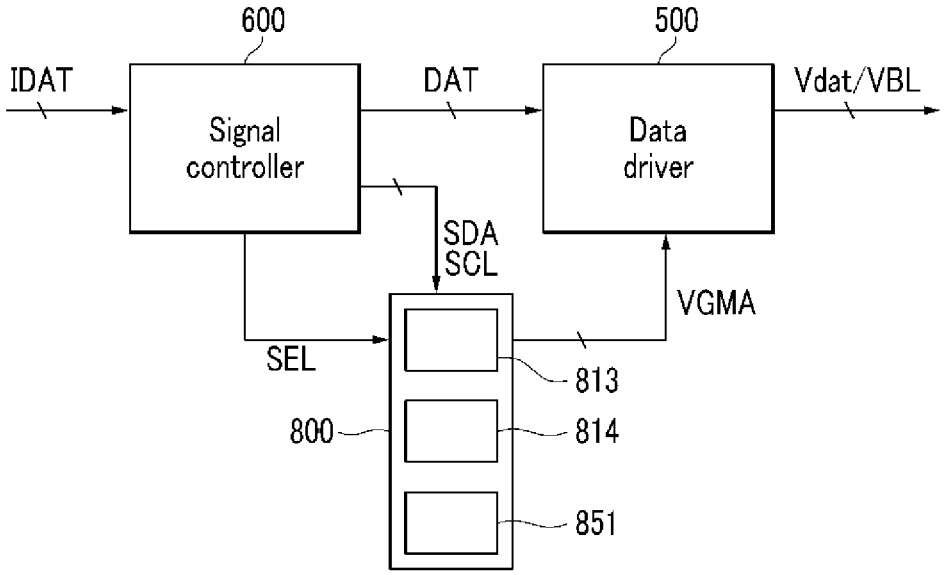
FIG. 15 is a block diagram of a driver of the display device according to exemplary embodiments of the present invention.

FIG. 15 is a block diagram of a driver of the display device according to exemplary embodiments of the present invention.

A gray voltage generator 800 according to exemplary embodiments of the present invention is basically the same as the exemplary embodiment of FIG. 3, except that the gray voltage generator 800 includes two registers 813 and 814 instead of one register. The two registers 813 and 814 store different digital gray reference data, and the digital gray reference data respectively correspond to gamma curves of the two subpixels PXa and PXb of one pixel PX.

The gray voltage generator 800 selects one of three registers including the two registers 813 and 814 and the additional register 851 according to the selection signal SEL, and generates one gray reference voltage or a predetermined number of gray reference voltages to generate the gray reference voltage according to the gamma curve for the subpixel PXa, the gray reference voltage according to the gamma curve for the subpixel PXb, or the black data voltage VBL corresponding to the insertion gray according to the selected registers 813, 814, and 851, and provides the gray reference voltage or the predetermined number of gray reference voltages to the data driver 500.

Accordingly, the data driver 500 supplies one of the image data voltage Vdat for the subpixel PXa, the image data voltage Vdat for the subpixel PXb, and the black data voltage VBL to the data line by using the gray reference voltage VGMA inputted from the gray voltage generator.

The gray voltage generator according to the exemplary embodiments of the display device shown in FIG. 13 and FIG. 14 is the same as the exemplary embodiments of FIG. 4, FIG. 5 and FIG. 6, and the driving method is also the same.

Next, an exemplary driving method of the display device in which the exemplary embodiment of FIG. 4 to FIG. 6 is applied to the exemplary embodiment of FIG. 13 to FIG. 15 is described with reference to FIG. 16. Like reference numerals are assigned to the same signals of the previous exemplary embodiment of FIG. 7, and the description thereof is omitted in order to avoid unnecessarily obscuring the invention.

Figure 16:
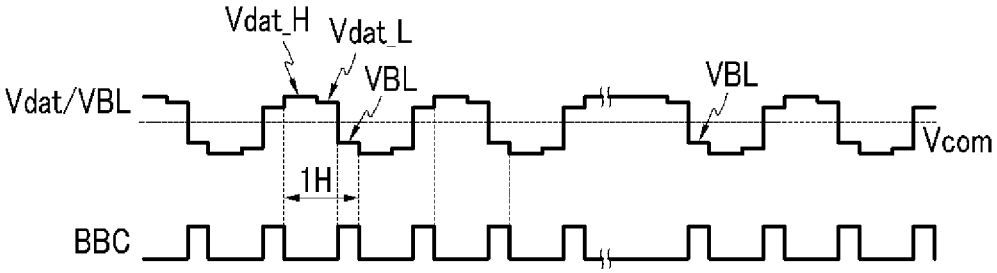
FIG. 16 is a diagram showing driving signals according to exemplary embodiments of the present invention.

FIG. 16 is a diagram showing several driving signals according to exemplary embodiments of the present invention.

Most of the exemplary embodiment of FIG. 16 is the same as that of the exemplary embodiment of FIG. 7, but in the present exemplary embodiment, the data line is sequentially supplied with the image data voltage Vdat_H for the subpixel PXa and the image data voltage Vdat_L for the subpixel PXb during the time that a pair of gate lines Gka and Gkb (k=1, . . . , n) are sequentially supplied with the gate-on voltage. In the present exemplary embodiment, in a black mode, the luminance of the subpixel PXa is higher than the luminance of the subpixel PXb. The image data voltages Vdat_H and Vdat_L applied to two subpixels PXa and PXb of one pixel PX have the same polarity.

In the exemplary embodiment of FIG. 16, the image data voltages Vdat_H and Vdat_L applied to one data line have a polarity inverted every 1H, thereby realizing row inversion or dot inversion.

Also, in the present exemplary embodiment, if the data line is applied with image data voltages Vdat_H/Vdat_L for two subpixels PXa and PXb and the corresponding pair of gate lines are sequentially applied with the gate-on voltage during the time when the transform signal BBC is low, the corresponding subpixels PXa and PXb display images having luminances according to different gamma curves and corresponding to the input image signal IDAT. Meanwhile, if the transform signal BBC is high, the data voltage of the data line becomes the black data voltage VBL representing the insertion gray such as the black-tone gray (e.g. 0 gray) or the middle-tone gray (e.g. 128 gray), and the two subpixels PXa and PXb display images having the luminance corresponding to the insertion gray.

The various characteristics and effects of the above exemplary embodiments of FIG. 1 through FIG. 8 may be applied to the exemplary embodiment of FIG. 13 to FIG. 16.

Exemplary embodiments of the present invention relate to the liquid crystal display, however, the present invention may be applied to various display devices using the gray voltage generator.

According to exemplary embodiments of the present invention, the gray reference voltage inputted to the data driver from the gray voltage generator is set as the voltage corresponding to the predetermined insertion gray such as black, such that the black data voltage may be actively applied to the data line like the image data voltage, and thereby the time for displaying the insertion gray may sufficiently be obtained without a reduction of the charging time of the image data voltage.

One of ordinary skill in the art would recognize that the processes for generating a gray voltage associated with an image signal to offset an afterimage of a display device may be implemented via software, hardware (e.g., general processor, Digital Signal Processing (DSP) chip, an Application Specific Integrated Circuit (ASIC), Field Programmable Gate Arrays (FPGAs), etc.), firmware, or a combination thereof. Such exemplary hardware for performing the described functions is detailed below with respect to FIG. 17.

Figure 17:
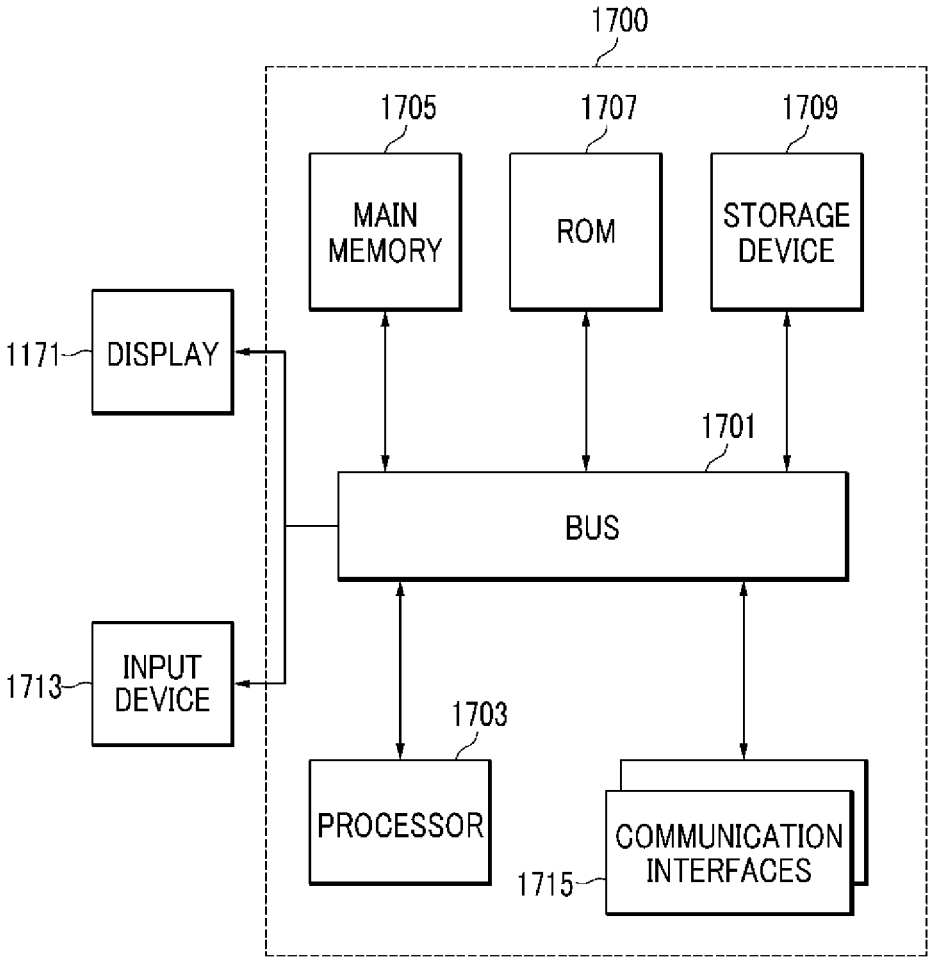
FIG. 17 is a diagram of hardware that can be used to implement an embodiment of the invention.

FIG. 17 illustrates exemplary hardware upon which various embodiments of the invention can be implemented. A computing system 1700 includes a bus 1701 or other communication mechanism for communicating information and a processor 1703 coupled to the bus 1701 for processing information. The computing system 1700 also includes main memory 1705, such as a random access memory (RAM) or other dynamic storage device, coupled to the bus 1701 for storing information and instructions to be executed by the processor 1703. Main memory 1705 can also be used for storing temporary variables or other intermediate information during execution of instructions by the processor 1703. The computing system 1700 may further include a read only memory (ROM) 1707 or other static storage device coupled to the bus 1701 for storing static information and instructions for the processor 1703. A storage device 1709, such as a magnetic disk or optical disk, is coupled to the bus 1701 for persistently storing information and instructions.

The computing system 1700 may be coupled with the bus 1701 to a display 1711, such as a liquid crystal display, or active matrix display, for displaying information to a user. An input device 1713, such as a keyboard including alphanumeric and other keys, may be coupled to the bus 1701 for communicating information and command selections to the processor 1703. The input device 1713 can include a cursor control, such as a mouse, a trackball, or cursor direction keys, for communicating direction information and command selections to the processor 1703 and for controlling cursor movement on the display 1711.

According to various embodiments of the invention, the processes described herein can be provided by the computing system 1700 in response to the processor 1703 executing an arrangement of instructions contained in main memory 1705. Such instructions can be read into main memory 1705 from another computer-readable medium, such as the storage device 1709. Execution of the arrangement of instructions contained in main memory 1705 causes the processor 1703 to perform the process steps described herein. One or more processors in a multi-processing arrangement may also be employed to execute the instructions contained in main memory 1705. In alternative embodiments, hard-wired circuitry may be used in place of or in combination with software instructions to implement the embodiment of the invention. In another example, reconfigurable hardware such as Field Programmable Gate Arrays (FPGAs) can be used, in which the functionality and connection topology of its logic gates are customizable at run-time, typically by programming memory look up tables. Thus, embodiments of the invention are not limited to any specific combination of hardware circuitry and software.

The computing system 1700 also includes at least one communication interface 1715 coupled to bus 1701. The communication interface 1715 provides a two-way data communication coupling to a network link (not shown). The communication interface 1715 sends and receives electrical, electromagnetic, or optical signals that carry digital data streams representing various types of information. Further, the communication interface 1715 can include peripheral interface devices, such as a Universal Serial Bus (USB) interface, a PCMCIA (Personal Computer Memory Card International Association) interface, etc.

The processor 1703 may execute the transmitted code while being received and/or store the code in the storage device 1709, or other non-volatile storage for later execution. In this manner, the computing system 1700 may obtain application code in the form of a carrier wave.

The term "computer-readable medium" as used herein refers to any medium that participates in providing instructions to the processor 1703 for execution. Such a medium may take many forms, including but not limited to non-volatile media, volatile media, and transmission media. Non-volatile media include, for example, optical or magnetic disks, such as the storage device 1709. Volatile media include dynamic memory, such as main memory 1705. Transmission media include coaxial cables, copper wire and fiber optics, including the wires that comprise the bus 1701. Transmission media can also take the form of acoustic, optical, or electromagnetic waves, such as those generated during radio frequency (RF) and infrared (IR) data communications. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, and EPROM, a FLASH-EPROM, any other memory chip or cartridge, a carrier wave, or any other medium from which a computer can read.

Various forms of computer-readable media may be involved in providing instructions to a processor for execution. For example, the instructions for carrying out at least part of the invention may initially be borne on a magnetic disk of a remote computer. In such a scenario, the remote computer loads the instructions into main memory and sends the instructions over a telephone line using a modem. A modem of a local system receives the data on the telephone line and uses an infrared transmitter to convert the data to an infrared signal and transmit the infrared signal to a portable computing device, such as a personal digital assistant (PDA) or a laptop. An infrared detector on the portable computing device receives the information and instructions borne by the infrared signal and places the data on a bus. The bus conveys the data to main memory, from which a processor retrieves and executes the instructions. The instructions received by main memory can optionally be stored on storage device either before or after execution by processor.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

a controller to process an input image signal and an input control signal and to output a digital image signal and a control signal;

a gray voltage generator to provide a plurality of first gray reference voltages when a selection signal is in a first state and to provide a single second gray reference voltage corresponding to an insertion gray when the selection signal is in a second state different from the first state; and a data driver to generate gray voltages based on the plurality of first gray reference voltages or the single second gray reference voltage provided from the gray voltage generator, to receive the digital image signal, to select a gray voltage corresponding to the digital image signal as a data voltage when the gray voltage generator provides the plurality of first gray reference voltages, and to generate an insertion data voltage corresponding to the insertion gray when the gray voltage generator provides the single second gray reference voltage, wherein the selection signal is periodically changed between the first state and the second state during one frame for the digital image signal.

2. The display device of claim 1, wherein:

the gray voltage generator comprises a first register to store first gray reference data, which is information for the plurality of first gray reference voltages, and a second register to store a second gray reference data, which is information for the single second gray reference voltage; and the first register or the second register is selected according to the selection signal.

3. The display device of claim 2, further comprising:

a data line to transmit the data voltage; and a pixel to receive the data voltage through the data line, wherein the pixel comprises a first subpixel and a second subpixel representing different luminances from each other for the same input image signal, and wherein the first register comprises a third register to store information for a gray reference voltage corresponding to a gamma curve for the first subpixel and a fourth register to store information of a gray reference voltage corresponding to a gamma curve for the second subpixel.

4. The display device of claim 3, wherein the insertion gray comprises a black-tone of gray or a middle-tone of gray.

5. The display device of claim 1, further comprising:

a transform circuit coupled to the gray voltage generator and being controlled according to a transform signal included in the control signal, wherein the gray voltage generator comprises a register to store first gray reference data which is information for the plurality of first gray reference voltages, and wherein the transform circuit is activated or deactivated according to a level of the transform signal, thereby changing the gray reference voltage generated by the gray voltage generator.

6. The display device of claim 5, further comprising:

a resistor column coupled between a driving voltage and a ground voltage, the resistor column to provide a reference voltage to the gray voltage generator to generate the gray reference voltage, wherein the transform circuit is activated according to the transform signal to change a voltage of a node between a plurality of resistors included in the resistor column, thereby changing the reference voltage.

7. The display device of claim 6, wherein the transform circuit is configured to change the driving voltage, the ground voltage, or both of the driving voltage and the ground voltage provided to the gray voltage generator.

8. The display device of claim 5, wherein the transform circuit is configured to change a driving voltage, a ground voltage, or both of the driving voltage and the ground voltage provided to the gray voltage generator.

9. The display device of claim 5, wherein the insertion gray comprises a black-tone gray or a middle-tone gray.

10. The display device of claim 1, wherein the insertion gray comprises a black-tone gray or a middle-tone gray.

11. A method for driving a display device comprising a controller to process an input image signal and an input control signal to control output of a digital image signal, a gray voltage generator to generate gray reference voltages, and a data driver to generate gray voltages based on the gray reference voltages, the method comprising:

generating a plurality of first gray reference voltages corresponding to the input image signal when a selection signal is in a first state and generating a single second gray reference voltage corresponding to an insertion gray when the selection signal is in a second state different from the first state;

sequentially receiving the plurality of first gray reference voltages and the single second gray reference voltage;

generating gray voltages based on the plurality of first gray reference voltages or the single second gray reference voltage; and selecting a gray voltage corresponding to the digital image signal as a data voltage when the plurality of first gray reference voltages are input, and generating an insertion data voltage corresponding to the insertion gray when the single second gray reference voltage is input, wherein the selection signal is periodically changed between the first state and the second state during one frame for the digital image signal.

12. The method of claim 11, wherein the gray voltage generator comprises:

a first register to store first gray reference data which is information for the plurality of first gray reference voltages; and a second register to store second gray reference data which is information for the single second gray reference voltage, the method further comprising:

selecting one of the first register and the second register according to the selection signal.

13. The method of claim 12, further comprising:

transmitting the data voltage and a pixel to receive the data voltage through the data line, the pixel comprising a first subpixel and a second subpixel representing different luminances to the input image signal, and storing information with respect to a gray reference voltage corresponding to a gamma curve with respect to the first subpixel and storing information of a gray reference voltage corresponding to a gamma curve with respect to the second subpixel.

14. The method of claim 11, further comprising:

controlling a transform circuit according to a transform signal comprising the control signal, and wherein the gray voltage generator comprises a register to store first gray reference data which is information for the plurality of first gray reference voltages, the method further comprising:

activating or deactivating the transform circuit according to a level of the transform signal, thereby changing the gray reference voltage generated by the gray voltage generator.

15. The method of claim 14, further comprising:

providing a reference voltage to the gray voltage generator, and activating the transform circuit according to the transform signal to change a voltage of a node generated between a plurality of resistors comprised in the resistor column, thereby changing the reference voltage.

16. The method of claim 15, further comprising:

changing the driving voltage, the ground voltage, or both of the driving voltage and the ground voltage provided to the gray voltage generator in the transform circuit.

17. The method of claim 14, further comprising:

changing a driving voltage, a ground voltage, or both of the driving voltage and the ground voltage provided to the gray voltage generator in the transform circuit.

18. The method of claim 11, wherein the insertion gray comprises a black-tone gray or a middle-tone gray.

19. The display device of claim 1, wherein the insertion gray is determined based on display characteristics separate from those of the input image signal.

20. The method of claim 11, wherein the insertion gray is determined based on display characteristics separate from those of the input image signal.

* * * * *